United States Patent [19]

Pruzick

[11] 4,135,184

[45] Jan. 16, 1979

[54] ELECTRONIC THEFT DETECTION SYSTEM FOR MONITORING WIDE PASSAGEWAYS

[75] Inventor: Ronald Pruzick, Commack, N.Y.

[73] Assignee: Knogo Corporation, Hicksville, N.Y.

[21] Appl. No.: 829,346

[22] Filed: Aug. 31, 1977

[51] Int. Cl.[2] ..... G08B 13/24

[52] U.S. Cl. ..... 340/572; 343/6.8 R; 343/867

[58] Field of Search ..... 340/280, 258 C; 343/6.8 R, 867

[56] References Cited

U.S. PATENT DOCUMENTS

| | | | |
|---|---|---|---|
| 1,863,741 | 6/1932 | Bouthillon | 343/867 |
| 2,252,641 | 8/1941 | Poliakoff et al. | 179/82 |
| 2,597,518 | 5/1952 | Parks | 177/353 |
| 2,963,627 | 12/1960 | Buchsbaum | 340/258 C |
| 3,182,314 | 5/1965 | Kleist et al. | 343/6.5 |
| 3,493,955 | 2/1970 | Minasy | 340/258 |
| 3,500,373 | 3/1970 | Minasy | 340/258 |
| 3,696,379 | 10/1972 | Minasy | 340/280 |
| 3,832,530 | 8/1974 | Reitbock et al. | 340/280 |
| 3,868,669 | 2/1975 | Minasy | 340/280 |
| 4,016,553 | 4/1977 | Novikoff et al. | 340/280 |

FOREIGN PATENT DOCUMENTS

| | | | |
|---|---|---|---|
| 763681 | 2/1934 | France | 340/280 |

*Primary Examiner*—Glen R. Swann, III

*Attorney, Agent, or Firm*—Fitzpatrick, Cella, Harper & Scinto

[57] ABSTRACT

An electronic theft detection system has a transmitting antenna and a receiving antenna located on the floor and overhead of a passageway being monitored. The antennas have conductors extending along and crossways of the passageway in staggered arrangement to provide system sensitivity for different paths of egress and different planes of orientation of resonant circuits to be detected. The transmitting antenna consists of a plurality of overlapping loops connected in phase, whereas the receiving antenna consists of a plurality of overlapping loops connected with alternating phase to provide cancellation of extraneous electrical disturbances.

14 Claims, 5 Drawing Figures

94
1
94
2
94
3
92
92
92
88
88
88
84
93a
93b
93c
90
90
90
86

ELECTRONIC THEFT DETECTION SYSTEM FOR MONITORING WIDE PASSAGEWAYS

BACKGROUND OF THE INVENTION

1. Field of the Invention

This invention relates to electronic systems for detecting the unauthorized passage of protected articles through an egress passageway and more particularly it concerns novel means in such systems for providing electronically monitored egress passageways of substantially unlimited width.

2. Description of the Prior Art

In U.S. Pat. No. 3,500,373 there is disclosed an electronic theft detection system for protecting articles of merchandise in a retail store. Each article to be protected is provided with a tag or label which contains a concealed resonant electrical circuit. Transmitter and receiver antennas are provided at an egress facility such as a doorway and the transmitter antenna is energized to generate an electromagnetic field in the vicinity of the doorway which varies cyclically in frequency, e.g., the frequency may shift over a range from 0.8 to 1.2 megahertz at a rate of 500 hertz. When a protected article, carrying a concealed resonant circuit tuned to resonate at a frequency within the sweep range, is carried into the electromagnetic field, it reacts with the field and produces a characteristic response. The exit region is continuously monitored for the occurrence of this distinctive response and when it is detected an alarm is sounded.

U.S. Pats. No. 3,696,379, No. 3,868,669 and No. 4,016,553 and copending U.S. Pat. application Ser. No. 697,128 filed June 17, 1976 show various additional features, adaptations and improvements to the basic system of U.S. Pat. No. 3,500,373.

U.S. Pat. No. 3,493,955 shows an electronic theft detection system which utilizes an electronic transponder circuit as a target on protected articles. This circuit responds to an electromagnetic interrogation signal at one frequency and retransmits at another frequency. Transmitter antennas are provided on the floor and one side of an egress passageway and a receiver antenna is provided on the opposite side of the passageway.

Copending U.S. Pat. application Ser. No. 715,568 filed Aug. 18, 1976 shows an electronic theft detection system which operates on a different principle, namely the detection of target strips of a saturable magnetic material such as permalloy. This is accomplished by producing an alternating magnetic interrogation field at a doorway and then detecting other fields which the target strips produce at harmonic frequencies when exposed to the interrogation field at the doorway. This magnetic type detection system uses transmitter and receiver coils in the form of partially overlapped loops on opposite sides of the doorway.

French Pat. No. 763,681 to P. A. Picard shows a similar detection system and in one embodiment there is shown a balanced receiver antenna comprising a double loop in the form of a figure eight. The afoementioned U.S. Pat. No. 4,016,553 also employs a balanced receiver antenna in the detection of resonant electrical circuits.

The theft detection systems of the prior art all utilize an antenna or field generating means, either a combined transmitter and receiver coil including a loop which extends around an egress passageway or separate transmitter and receiver antennas on opposite sides of the egress passageway. This field generating means provides adequate signal energy levels across the passageway but they do limit the effective width of the passageway. In general, the systems which employed resonant electrical circuits to be detected had passageway widths of about thirty three inches (84 cm.) while the systems which employed saturable magnetic strips to be detected had passageway widths of about thirty inches (76 cm.).

In modern merchandising operations such as in shopping malls, it is often desired to provide store entrances with very wide and unobstructed openings. This facilitates movement of customers into and out from the store and it provides a less intimidating and a more inviting appearance than a conventional doorway provides. Such large passageways, however, are not suited to the theft detection systems of the prior art because the antenna arrangements of those systems caused confinement of the width of the egress passageway and thus conflicted with the concept of a wide and unobstructed opening.

SUMMARY OF THE INVENTION

The present invention solves the above described problem of the prior art by providing in a resonant circuit type theft detection system, novel transmitter and receiver antennas each lying in a flat, horizontal plane in substantial alignment with each other, with one of the antennas positioned on the floor of a passageway at an interrogation zone and the other positioned overhead so that a person who walks through the interrogation zone passes between the antennas. Each antenna comprises a plurality of conductors connected together in series to form a closed circuit with the transmitter and the receiver respectively. The conductors of each antenna comprise a first group extending crossways of the interrogation zone and a second group extending along the interrogation zone. The conductors of each group are spaced apart and are staggered with respect to each other so that different conductors of each group extend over different portions of the distance crossways of and along the interrogation zone.

The horizontal antenna arrangement eliminates the need for lateral physical boundaries at the egress passageway from the protected area and yet the system is adaptable to provide an interrogation zone for an egress passageway of any desired width.

The staggered arrangement of spaced apart antenna conductors crossways of and along the interrogation zone provides effective electromagnetic field coverage along substantially every path through the interrogation zone and at substantially every possible orientation of the resonant circuits being detected. While no one conductor extends fully along the length of or fully across the interrogation zone, the composite array of conductors does extend fully along the length of and across the zone. In this way electromagnetic field coverage is provided without the mutual field cancelling effects which characterize the aligned adjacent conductors of loop antennas and coils.

A preferred arrangement of the conductors of each antenna takes the form of a pair of serially connected, coplanar partially overlapped loops with the transmitter connected loops being positioned such that electrical current flows around each loop serially in the same direction and in the receiver antenna electrical current flows around each loop serially in mutually opposite directions. The antennas are of the same size and overall configuration and they are positioned in substantial alignment so that the currents induced directly into the receiver antenna from the transmitter antenna will effectively cancel but the current variations caused by the passage of a resonant circuit through the interrogation zone will be greater in some of the conductors of the receiver antenna than in others so that cancellation will not occur and those variations will be detected.

According to a more specific feature of the present invention a plurality of pairs of transmitter and receiver antennas, as above described, are arranged adjacent to each other, each pair extending over a different portion of the distance crosswise of the interrogation zone. Each pair of transmitter and receiver antennas is provided with its own associated transmitter, receiver and alarm means. This arrangement makes it possible to ascertain which of several persons passing simultaneously through a wide exit passageway is carrying a protected article. In order to avoid any cross coupling between the transmitter antenna of one pair and the receiver antenna of another pair the system may be time sequenced so that adjacent pairs are not operational at exactly the same time.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the purposes of this invention. It is important, therefore, that this disclosure be regarded as including such equivalent arrangements as do not depart from the spirit and scope of the invention.

BRIEF DESCRIPTION OF THE DRAWINGS

Several embodiments of the invention have been chosen for purposes of illustration and description, and are shown in the accompanying drawings forming a part of the specification, wherein.

DETAILED DESCRIPTION OF THE PREFERRED EMBODIMENTS

Figure 1:
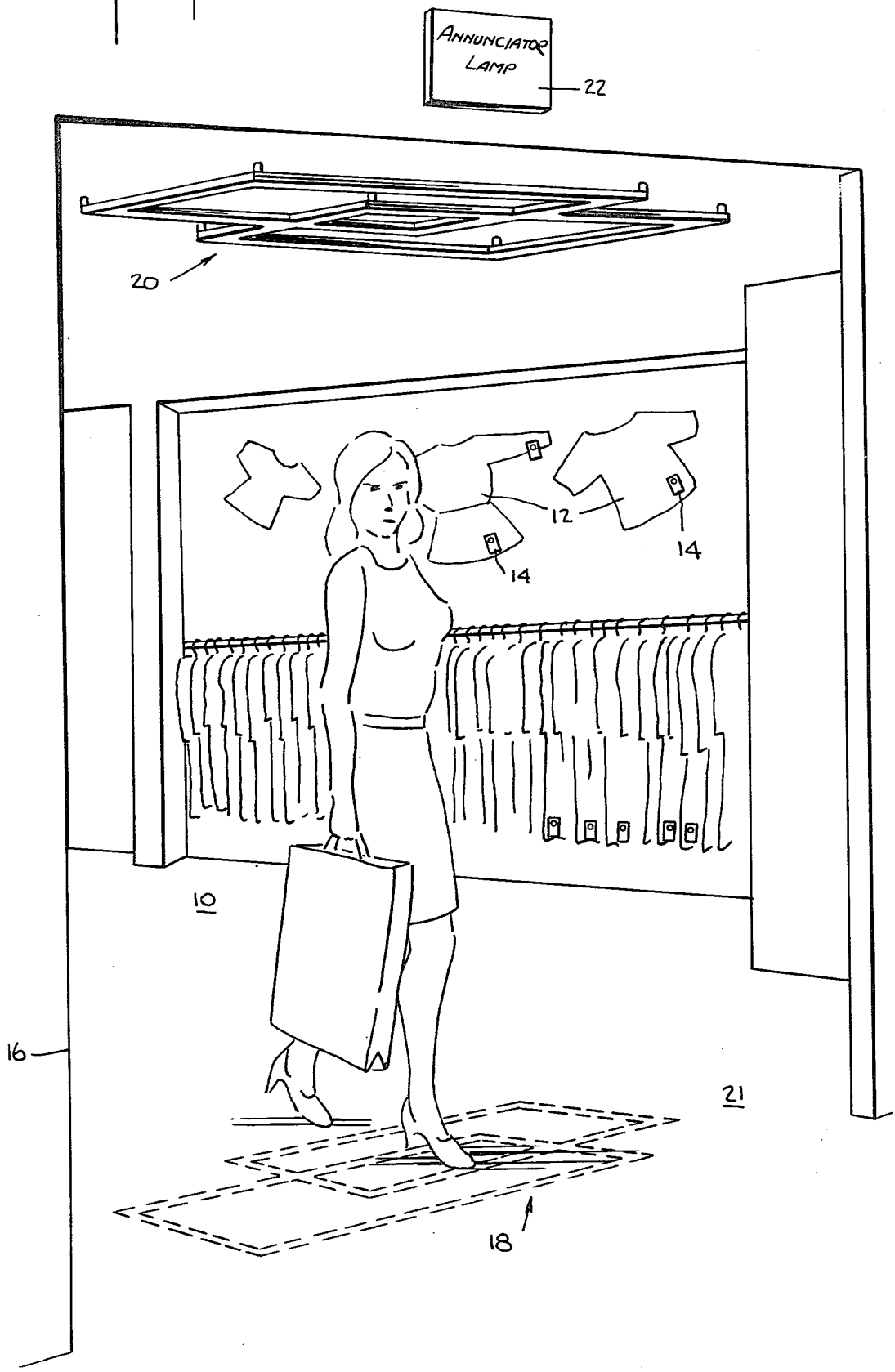
FIG. 1 is a perspective view showing a store exit provided with an antenna arrangement for an electronic theft detection system according to the present invention.

In FIG. 1 there is shown a protected area 10, such as the interior of a store, or a particular department within a store, in which articles of merchandise 12, such as clothing, is displayed for inspection prior to sale. Each article of merchandise 12 is provided with a tag or label 14 which carries within it a resonant electrical circuit. The tag or label 14 cannot be removed from the article 12 except by an authorized person, such as a sales clerk, when a legitimate purchase is made. The fastening means for securing the tag or label 14 to the article 12 is not part of this invention and will not be described herein. Suitable fastening means which require special removal tool are shown and described in U.S. Pat. No. 3,628,267 and in U.S. Pat. No. 3,911,534 (now disclaimed).

Customers and potential customers may enter into and exit from the protected area 10 via a passageway 16 such as an open arch, as shown, or a doorway. A receiver antenna 18 is positioned on the floor at the passageway 16 while a transmitter antenna 20 is positioned overhead so that customers must pass between the antennas as they enter and exit through the passageway. The antennas 18 and 20, as will be described more fully hereinafter, are connected to an electrical detection system which causes the transmitter antenna 20 to generate an electromagnetic interrogation field throughout an interrogation zone 21 extending crossways of and a short distance along the passageway. When an article 12 is carried through the interrogation zone 21 with a label or tag 14 attached to it the resonant circuit within the label or tag interacts with the electromagnetic interrogation field. The electromagnetic responses which result from this interaction produce electrical signals in the receiver antenna 18 and these signals are used to produce an audio or visual alarm. By way of example an annunciator lamp 22 may be provided above the passageway 16 as shown in FIG. 1; and the detection system may be arranged to light this lamp for the production of a visual alarm. Other alarm arrangements may be utilized as desired.

When an article 12 is actually purchased, the sales clerk removes the label or tag 14 with its resonant circuit so that when the article is brought through the interrogation zone 21 it will not interact with the interrogation field and no alarm will be produced.

The electrical components of the detection system itself also do not constitute the novel feature of this invention. A preferred, swept frequency electrical detection system is shown and described in detail in U.S. Pat. No. 3,500,373.

Figure 2:
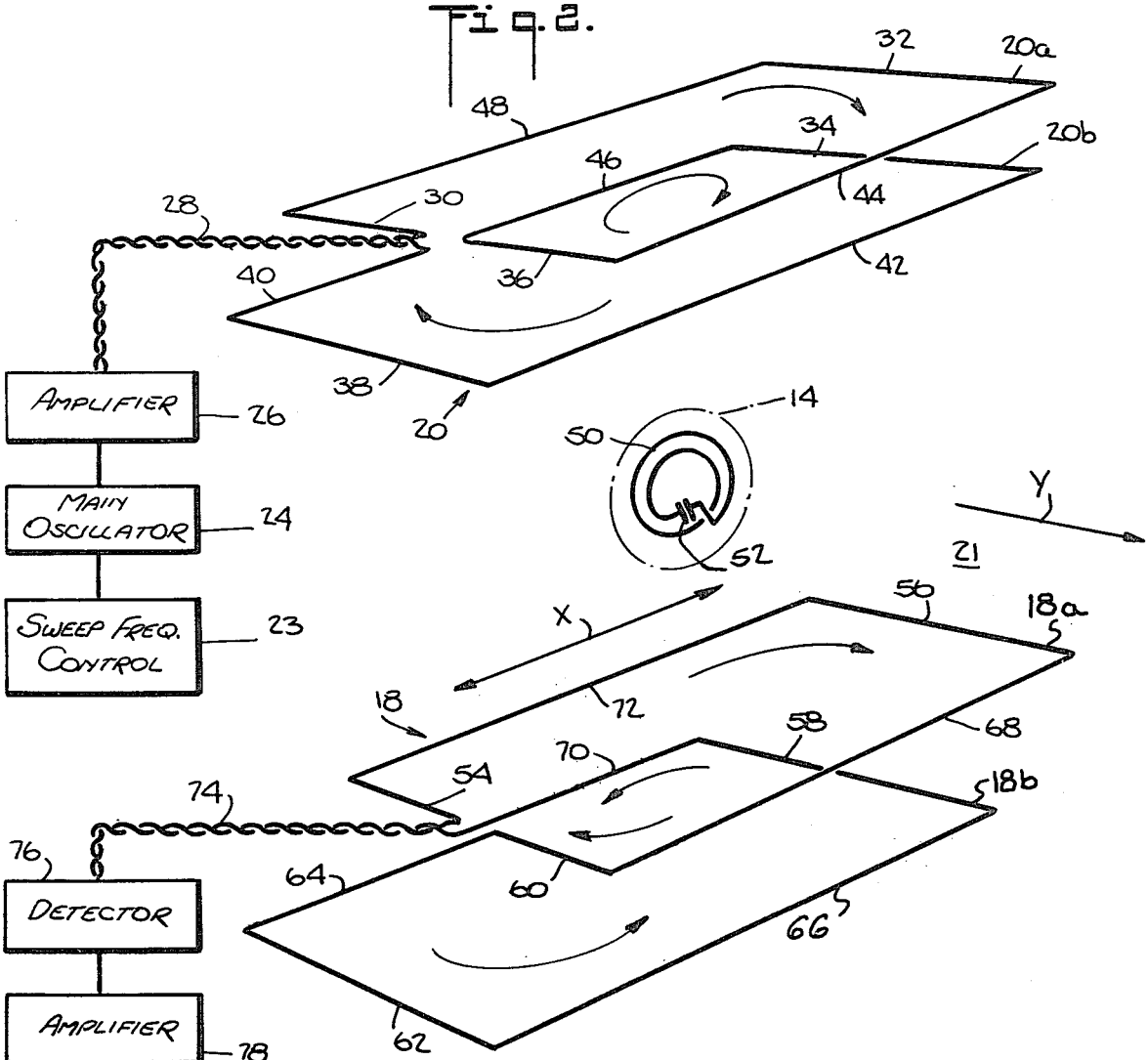
FIG. 2 is a diagrammatic representation showing a block diagram of the electronic theft detection system employed in FIG. 1 and further showing the manner in which the antenna arrangement is wound.

FIG. 2 shows diagrammatically the general electrical arrangement of the detection system employed in FIG. 1. As shown in FIG. 2 a sweep frequency control oscillator 23 is connected to a main oscillator 24. The sweep frequency control oscillator operates at a relatively low frequency, e.g., 300 hertz; and its output is used to tune the main oscillator 24 in a cyclical manner. As a result, the main oscillator produces an output signal which varies between 1.95 and 2.05 megahertz at a 300 hertz rate. This signal is generally referred to as a sweft frequency signal.

The output of the main oscillator 24 is connected to an amplifier 26, which amplifies the swept frequency signal and produces electrical currents also having a swept frequency characteristic. The amplifier 26 in turn is connected via transmitter leads 28 to the transmitter antenna 20.

Figure 3:
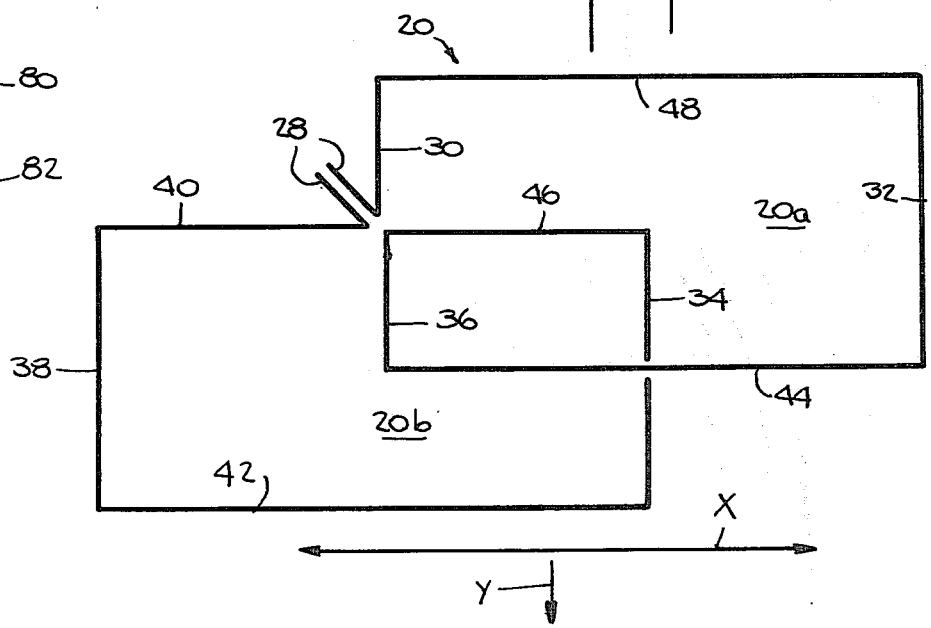
FIG. 3 is a plan view showing in outline the antenna arrangement of FIGS. 1 and 2.

The transmitter antenna 20 is shown in perspective in FIG. 2 and in plan in FIG. 3. As can be seen in these drawings the transmitter antenna 20 includes a first group of spaced apart conductors 30, 32, 34, 36 and 38 extending in a direction Y along the interrogation zone 21. These conductors are staggered in that different ones of the conductors extend over different portions of the distance along the interrogation zone. Thus while no one conductor extends over the entire distance along the interrogation zone, the overall group of conductors does extend over this entire distance. The transmitter antenna 20 further includes a second group of spaced apart conductors 40, 42, 44, 46 and 48 extending in a direction X crossways of the interrogation zone 21. The conductors of this second group are also staggered in that different ones of the conductors extend over different portions of the distance across the interrogation zone. Again, while no one conductor extends over the entire distance across the interrogation zone the overall group of conductors does extend over this entire distance. The several conductors of the transmitter antenna 20 are connected together serially in the form of two horizontal, coplanar, partially overlapping, one turn loops 20*a* and 20*b* wound in the same direction so that electrical current flowing in a given direction through one loop will at the same time flow in the same direction through the other loop.

The swept frequency electrical currents supplied to the transmitter antenna 20 are converted by the antenna to corresponding swept frequency electromagnetic fields in the vicinity of the antenna. These fields have a configuration corresponding to the arrangements of the staggered arrangement of conductors forming the loops 20*a* and 20*b*.

The tag or label 14 is shown in phantom outline between the antennas 18 and 20 in FIG. 2; and the resonant electrical circuit embedded in the tag or label is shown to comprise a coil 50 and a capacitor 52 connected in parallel with each other. The coil and capacitor are tuned to resonate at a particular frequency within the sweep frequency range of the electrical signals produced by the tuning of the main oscillator 24, e.g., 2.0 megahertz. The resonant electrical circuit produces a characteristic eletromagnetic response in the presence of the swept frequency electromagnetic field produced by the transmitter antenna 20 and this response produces corresponding electrical current variations in the receiver antenna 18.

The receiver antenna 18 also includes a first group of spaced apart conductors 54, 56, 58, 60 and 62 extending in staggered arrangement in the direction Y along the interrogation zone 21 and a second group of spaced apart conductors 64, 66, 68, 70 and 72 extending in staggered arrangement in the direction X crossways of the interrogation zone. The conductors of these two groups are also connected together serially in the form of two horizontal, coplanar, partially overlapping one turn loops 18*a* and 18*b*. These loops are of the same size and configuration as the loops 20*a* and 20*b* of the transmitter antenna 20 and they are in substantial alignment with the transmitter antenna loops. However, while the transmitter antenna loops are wound in the same direction the receiver antenna loops 18*a* and 18*b* are wound in mutually opposite directions so that electrical current flowing in one direction through one of the loops will at the same time flow in the opposite direction through the other loop.

The receiver antenna 18 is connected via receiver leads 74 to a detector 76 which detects the electrical current variations produced in the receiver antenna 18 by the resonant electrical circuit 50, 52. The detector 76 is connected to an amplifier 78 which amplifies its output and the amplifier 78 in turn is connected to filtering and signal processing circuits 80. The filtering and signal processing circuits are constructed and arranged, as described in the aforementioned U.S. Pat. No. 3,500,373 to separate the detected current variations having the distinctive signal characteristic corresponding to the presence of a resonant circuit 50, 52 in the passageway between the antenna 18 and 20 from other detected current variations caused by noise and extraneous electrical disturbances. The filtering and signal processing circuits 80 are connected to an alarm 82 and they actuate this alarm when such separation takes place.

As indicated above, a swept frequency theft detection system for detecting the presence of resonant electrical circuits on articles of merchandise is known in the prior art. The present invention, however, provides novel arrangements whereby this type of theft detection system can be used effectively in stores or store departments having large unobstructed openings or passageways permitting free movement of customers into and out from the store or protected area within the store.

It will be noted that the antennas 18 and 20 lie in flat horizontal planes on the floor and overhead of the passageway 16 and that no portion of the theft detection system obstructs the sides of the passageway. Thus the antennas may be completely hidden from view, with the receiver antenna 18 embedded in the floor or lying thereon and covered by a mat and the transmitter antenna. Preferably the vertical spacing between the antennas is about seven feet (213 cm.). This permits customers to walk comfortably between the antennas and at the same time it permits the system to be operated at moderate power levels so that the interrogation field will be contained in the portion of the passageway 16 between the antennas.

It has been found that the arrangement of antenna conductors is staggered array in directions crossways of and along the interrogation zone provides for the generation of and sensitivity to electromagnetic fields along each path of egress through the interrogation zone 21. This occurs because the cancellation effects encountered as a result of the use of loop antennas are minimized or at least distributed so that along any path through the interrogation zone there is a region of high sensitivity to the presence of a resonant circuit to be detected irrespective of the orientation of the resonant circuit.

The two loops of each of the antennas 18 and 20 are preferably rectangular in configuration and they overlap in a diagonal direction so that one corner of each loop lies in the center of the other loop.

The overall dimension of the antenna loops in the direction X crossways of the passageway 16 and of the interrogation zone 21 is chosen to be as large as the width of the passageway or it may extend over any selected portion of the width of the passageway which is chosen to constitute the interrogation zone. The dimension of each of the antenna loops in the direction Y along the passageway 16 and of the interrogation zone 21 is chosen to be from twenty to forty percent of the distance between the antennas. Thus, where the distance between the antennas 18 and 20 is seven feet (213 cm.) the length of each of the conductors which extend in the Y direction is between seventeen and thirty four inches (43 to 86 cm.). Should this length be less than twenty percent of the antenna spacing, the ability of the antenna system to obtain detectable responses becomes impared for some orientations and positions of the tag or label on a protected article carried through the passageway. Further, should the length of each conductor extending in the Y direction be greater than forty percent of the antenna spacing, the fields produced by the transmitter antenna may adversely affect other resonant circuits or other electrical equipment in the protected area. Also, in such case, the receiver antenna may detect the presence of other resonant circuits in the protected area which are not being carried through the passageway 16.

Figure 4:
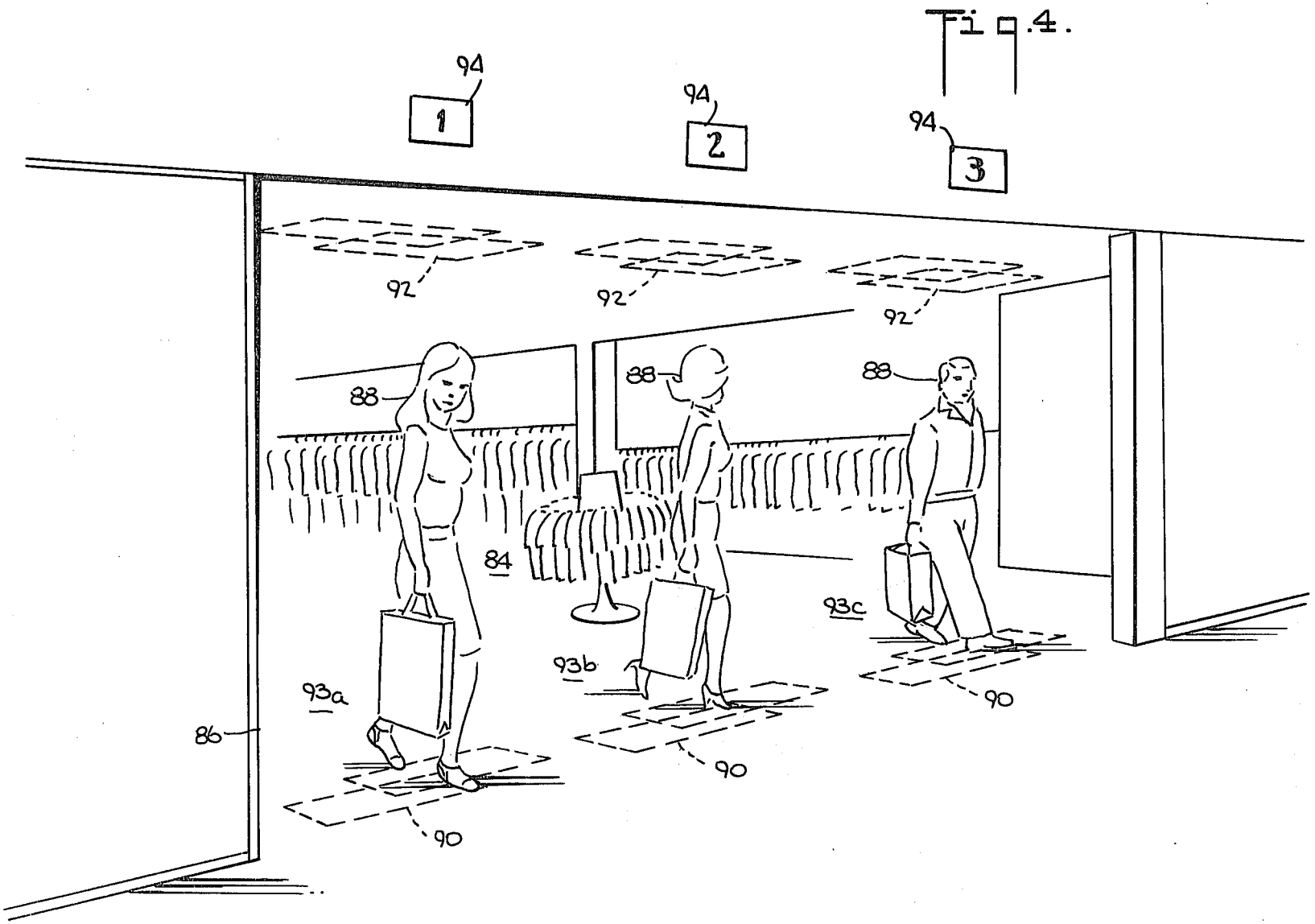
FIG. 4 is a perspective view showing a widened store exit provided with an antenna arrangement for an electronic theft detection system forming a second embodiment of the present invention.
Figure 5:
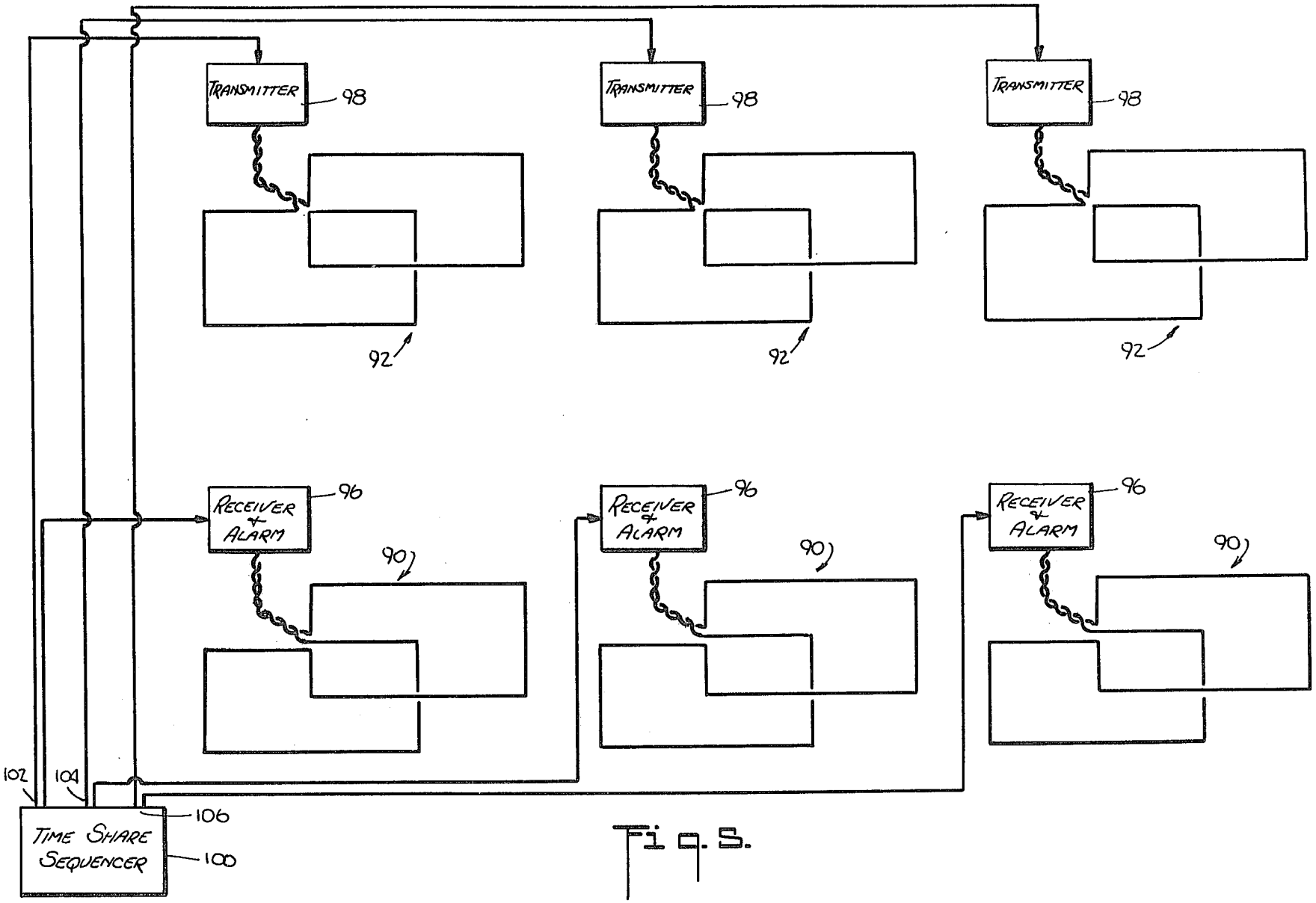
FIG. 5 is a diagrammatic view showing a wiring diagram of the antenna arrangement of FIG. 4 and a block diagram of the electronic theft detection system used therewith.

FIGS. 4 and 5 show a modification of the invention for monitoring passageways which are especially wide and which may accommodate the simultaneous movement of several people into and out from a protected area. As shown in FIG. 4 a protected area 84 such as a department store interior is formed with a very wide opening 86 forming as entrance and egress pasageway so that several customers 88 may move into and out from the protected area at the same time. As shown in dashed outline, three pairs of mutually aligned receiver and transmitter antennas 90 and 92, of the same construction as the antennas 18 and 20 of FIGS. 1–3, are arranged on the floor and overhead of the opening 86. Each pair of these antennas extends over a distance of approximately one third the width of the opening 86 to define adjacent interrogation zones 93*a*, 93*b* and 93*c*. Each pair of antennas is also provided with an associated transmitter and receiver and alarm system (not shown in FIG. 4), as described above in connection with FIG. 2; and each system may be provided with an annunciator lamp 94 positioned above the opening 86 in alignment with each pair of associated antennas. This arrangement permits free movement of persons through any one of the interrogation zones 93*a*, 93*b* or 93*c* without any lateral restraint and furthermore it permits simultaneous movement of several persons into and out from the protected area. Should any one of these persons be carrying an article tagged with a resonant circuit, the circuit will be detected by the particular pair of antennas between which the article is carried. This will cause lighting of the associated annunciator lamp 94 to identify the particular individual with the protected article.

FIG. 5 shows in diagrammatic form the antenna, transmitter and receiver and alarm arrangements employed in the system of FIG. 4 As can be seen each of the receiver antennas 90 is connected to a receiver and alarm 96 which may be the same as the detector, amplifier, filter and signal processor and alarm of FIG. 2. Also each of the transmitter antennas is connected to a transmitter 98 which may comprise the sweep frequency control oscillator, the main oscillator and the amplifier of FIG. 2. In order to insure against the production of an unbalanced condition in the receiver antennas by interrogation signals from adjacent, non-aligned transmitter antennas a time share sequencer 100 is provided. This time share sequencer is simply a time delay device having groups of output terminals 102, 104 and 106 which are electrically energized in a time shared sequence. Each group of outut terminals is connected to the transmitter 98 and the receiver and alarm 96 of an associated group of antennas so that each transmitter and its associated receiver and alarm is in operaton only when it is energized from the time share sequencer 100. With this arrangement only one of any two adjacent detection groups is in operation at any one time so that during such time the operating receiver antenna will be exposed only to signals from the transmitter antenna which is aligned with it. These signals will have a substantially equal and opposite effect on both loops of the receiver antenna and will effectively be cancelled. Signals from adjacent, non-aligned, transmitter antennas, which might produce unbalanced and non-cancelling effects in the operating receiver antenna, are suppressed.

It is to be understood in connection with the foregoing that while the transmitter antennas 20 and 92 are shown as being mounted overhead and the receiver antennas 18 and 90 are shown as being mounted on the floor of their respective passageway 16 and 86, the positions of these antennas may be reversed so that the receiver antenna is mounted overhead and the transmitter antenna is mounted on the floor.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended thereto.

What is claimed and desired to be secured by letters patent is:

1. An electronic theft detection system for detecting the unauthorized passage of articles through an interrogation zone at a passageway leading from a protected area, said system comprising signal transmitter means, including a transmitting antenna, for generating electromagnetic interrogation signals of predetermined frequency at said interrogation zone, electrical target circuits tuned to resonate at said predetermined frequency and attached to articles in said protected area and receiver means, including a receiver antenna, for detecting the electromagnetic effects produced by the resonating of said target circuits when they pass through said interrogation zone, said transmitter antenna and said receiver antenna lying in flat, horizontal planes in substantial alignment with each other, with one of said antennas positioned on the floor of said passageway at said interrogation zone and the other antenna positioned overhead above said one antenna so that a person who walks through said interrogation zone passes between said antennas, each antenna comprising a plurality of conductors connected together in series to form a closed circuit with said transmitter means and sad receiver means, respectively, a first group of the conductors of each antenna extending along said interrogation zone and a second group of the conductors of each antenna extending crossways of said interrogation zone, the conductors of each group being spaced apart and staggered with respect to each other so that different conductors of each group extend over different portions of the distance crossways of and along said interrogation zone.

2. An electronic theft detection system according to claim 1 wherein said transmitter antenna and said receiver antenna are of substantially the same configuration.

3. An electronic theft detection system according to claim 1 wherein said transmitter antenna and said receiver antenna each extend across said interrogation zone and wherein each antenna includes conductors which extend in a direction along said zone by a distance at least twenty percent as great as the distance between said antennas.

4. An electronic theft detection system according to claim 3 wherein said conductors extend in a direction along said zone by a distance less than forty percent as great as the distance between said antennas.

5. An electronic theft detection system according to claim 1 wherein said transmitter and receiver antennas each comprise at least two partially overlapped loops.

6. An electronic theft detection system according to claim 5 wherein the transmitter antenna loops are arranged such that current flows in the same direction through each loop and wherein the receiver antenna loops are arranged such that current flows in opposite direction through each loop.

7. An electronic theft detection system according to claim 6 wherein the loops of each antenna are substantially the same size.

8. An electronic theft detection system according to claim 5 wherein said loops are substantially rectangular.

9. An electronic theft detection system according to claim 8 wherein said loops are overlapped along a diagonal line such that one corner of each loop is located at the center of another loop.

10. An electronic theft detection system according to claim 1 wherein there are provided plural adjacent pairs of transmitter and receiver antennas defining adjacent interrogation zones in said passageway.

11. An electronic theft detection system according to claim 10 wherein said plural adjacent pairs of transmitter and receiver antennas are distributed across said passageway.

12. An electronic theft detection system according to claim 11 wherein individual transmitter and receiver means are connected to the transmitter and receiver antennas, respectively, of each pair.

13. An electronic theft detection system according to claim 12 wherein said transmitter and receiver means are connected to operate in a time shared sequence.

14. An electronic theft detection system according to claim 1 wherein said transmitter means is a swept frequency transmitter which produces an electronic signal which varies continually in a cyclical manner at a predetermined cyclical rate over a predetermined frequency range which includes the predetermined resonant frequency of said electrical target circuits.

* * * * *